US009630797B2

(12) United States Patent
Ferracane et al.

(10) Patent No.: US 9,630,797 B2
(45) Date of Patent: Apr. 25, 2017

(54) DISPENSER FOR MATERIAL

(71) Applicant: The Glad Products Company, Oakland, CA (US)

(72) Inventors: Dean A. Ferracane, Willowbrook, IL (US); Ronald J. Cisek, Willowbrook, IL (US); Ryan J. Coonce, Willowbrook, IL (US); Roger Sharpe, Mountain View, CA (US); Seitu Barron, Fremont, CA (US); John E. Rusnak, Willowbrook, IL (US)

(73) Assignee: The Glad Products Company, Oakland, CA (US)

( * ) Notice: Subject to any disclaimer, the term of this patent is extended or adjusted under 35 U.S.C. 154(b) by 28 days.

(21) Appl. No.: 14/568,474

(22) Filed: Dec. 12, 2014

(65) Prior Publication Data

US 2016/0167915 A1 Jun. 16, 2016

(51) Int. Cl.
*B65H 35/00* (2006.01)

(52) U.S. Cl.
CPC ..... *B65H 35/002* (2013.01); *B65H 35/0086* (2013.01); *B65H 2701/1752* (2013.01)

(58) Field of Classification Search
CPC ..... B65H 35/002; B65H 35/0086; B65H 2701/1752; B65H 35/0026; B65H 35/0033; B65H 35/004; B65H 75/28; B65H 75/285; B65H 16/028; B65H 35/006; B65H 35/04; B65H 35/10; B65D 85/67; B65D 85/671; B65D 83/0805; B65D 83/0875; Y10T 83/323; Y10T 83/566; Y10T 83/8821; Y10T 83/8822; Y10T 225/10; Y10T 225/16; Y10T 225/201; Y10T 225/238
See application file for complete search history.

(56) References Cited

U.S. PATENT DOCUMENTS

| | | | |
|---|---|---|---|
| 3,419,201 | A | 12/1968 | Brandon |
| 4,417,495 | A | 11/1983 | Gordon et al. |
| 5,107,732 | A | 4/1992 | Hanmer et al. |
| 5,146,828 | A | 9/1992 | Huang et al. |
| 6,725,753 | B2 | 4/2004 | Bell et al. |

(Continued)

OTHER PUBLICATIONS

International Search Report, mailed Mar. 2, 2016, from counterpart PCT/US15/64538, filing date Dec. 8, 2015.

*Primary Examiner* — Jonathan Riley
*Assistant Examiner* — Liang Dong
(74) *Attorney, Agent, or Firm* — Thomas C. Feix

(57) ABSTRACT

The container may hold a material, such as, plastic wrap. The first container portion may include a first leg with an engagement member. The engagement member may engage the second leg during the cutting process. In addition, the engagement member may disengage from the second leg during or after the cutting process. When the user wishes to cut the material, the user pushes down on the first container portion. The material is held between the engagement member and the second leg at a first location. The third leg may assist in holding the material at a second location. The holding of the material in tension may facilitate the cutting of the material. As the user continues to push down on the first container portion, the engagement member disengages from the second leg. The user can remove the portion of material without opening the first container portion.

25 Claims, 12 Drawing Sheets

(56) References Cited

U.S. PATENT DOCUMENTS

| | | | | |
|---|---|---|---|---|
| D522,782 | S | 6/2006 | Benedetti et al. | |
| D666,442 | S | 9/2012 | Sharp et al. | |
| 2004/0144825 | A1 | 7/2004 | Vandenberg et al. | |
| 2005/0166730 | A1 | 8/2005 | Benedetti et al. | |
| 2005/0205637 | A1 | 9/2005 | Kazama et al. | |
| 2008/0190257 | A1 | 8/2008 | Hanmer et al. | |
| 2013/0064612 | A1* | 3/2013 | Tucker ..... | B65H 35/002 407/1 |

* cited by examiner

DISPENSER FOR MATERIAL

BACKGROUND OF THE INVENTION

Most films used for food preparation or storage (i.e., aluminum foil, plastic wrap, parchment paper, etc.) are housed on cylindrical cores and bought by consumers in roll format. Traditionally, consistent cutting has been a consumer frustration, especially for plastic wrap, leading to a poor experience and below average usability.

BRIEF SUMMARY

The container may include a first container portion and a second container portion. In one embodiment, the first container portion may be a lid and the second container portion may be a bottom housing. The first container portion may move relative to the second container portion. In one embodiment, the first container portion may pivot relative to the second container portion at pivot point. In one embodiment, the pivot point may be a hinge.

The second container portion may hold a material. In one embodiment, the material may be plastic wrap. In other embodiments, the material may be aluminum foil, parchment paper, or wax paper. In one embodiment, the material may be in a roll format. The material may be applied to a cylindrical core.

The first container portion may include a cutting portion. The cutting portion may be used to cut the material. In one embodiment, the cutting portion may have a series of peaks and valleys. In other embodiments, the cutting portion may have a straight edge. The cutting portion may extend downward towards the second container portion.

The first container portion may include a first leg. The first container portion may include a base portion. The first leg may extend away from the base portion.

The first leg may include an engagement member. In one embodiment, the engagement member may extend toward the second leg when the container is in the intermediate position or closed position. The engagement member may engage the second leg during the cutting process. In addition, the engagement member may disengage from the second leg during or after the cutting process.

In one embodiment, the second container portion may include a third leg. The second container portion may include a base portion. The third leg may extend away from the base portion. The third leg may be located near the second leg. In one embodiment, the third leg may be adjacent the second leg.

The third leg may include a slip reducing surface. The slip reducing surface may increase the coefficient of friction between the material and the third leg. In one embodiment, the slip reducing surface may be a material which is applied to the third leg. For example, the slip reducing surface may be a thermoplastic elastomer applied to the third leg.

In one embodiment, the first container portion may include a fourth leg. The fourth leg may extend away from the base portion. The fourth leg may be located near the first leg. In one embodiment, the fourth leg may be adjacent to the cutting portion.

The container will operate in the following manner. The user pulls out the free end of the material to the desired length. When the user wishes to cut the material, the user pushes down on the first container portion. The engagement member engages the second leg. The material is held between the engagement member and the second leg at a first location. In one embodiment, the material may also contact the third leg. The third leg may assist in holding the material at a second location. In one embodiment, the third leg may include the slip reducing surface. The slip reducing surface may assist in holding the material at the second location.

In addition, the cutting portion will contact the material when the user pushes down on the first container portion. The cutting portion will cut the material. The cutting of the material is assisted by the material being held between the engagement member and the second leg. In addition, the cutting of the material may be assisted by the holding of the material on the third leg. The holding of the material in tension may facilitate the cutting of the material.

As the user continues to push down on the first container portion, the engagement member disengages from the second leg. The portion of material which has been cut, is no longer held between the engagement member and the second leg. Consequently, the portion of material may be removed when the engagement member disengages from the second leg. Therefore, when the first container portion is in the closed position, the portion of material may be removed. Thus, the user can remove the portion of material without opening the first container portion.

The engagement member may also create an involuntary increase in cutting speed by the user. When the user pushes on the first container portion, the engagement between the engagement member and the second leg creates resistance as the user pushes on the first container portion. After the engagement member disengages from the second leg, the force required by the user decreases and the user involuntarily increases the speed of the first container portion. The increase in speed may aid in cut quality.

The disengagement of the engagement member from the second leg may provide a tactile indication to the user that the cutting operation has been completed.

The user may also receive an auditory indication that the cutting operation has been completed. The disengagement of the engagement member from the second leg may provide an auditory indication, such as, a sound.

DESCRIPTION

Figure 1:
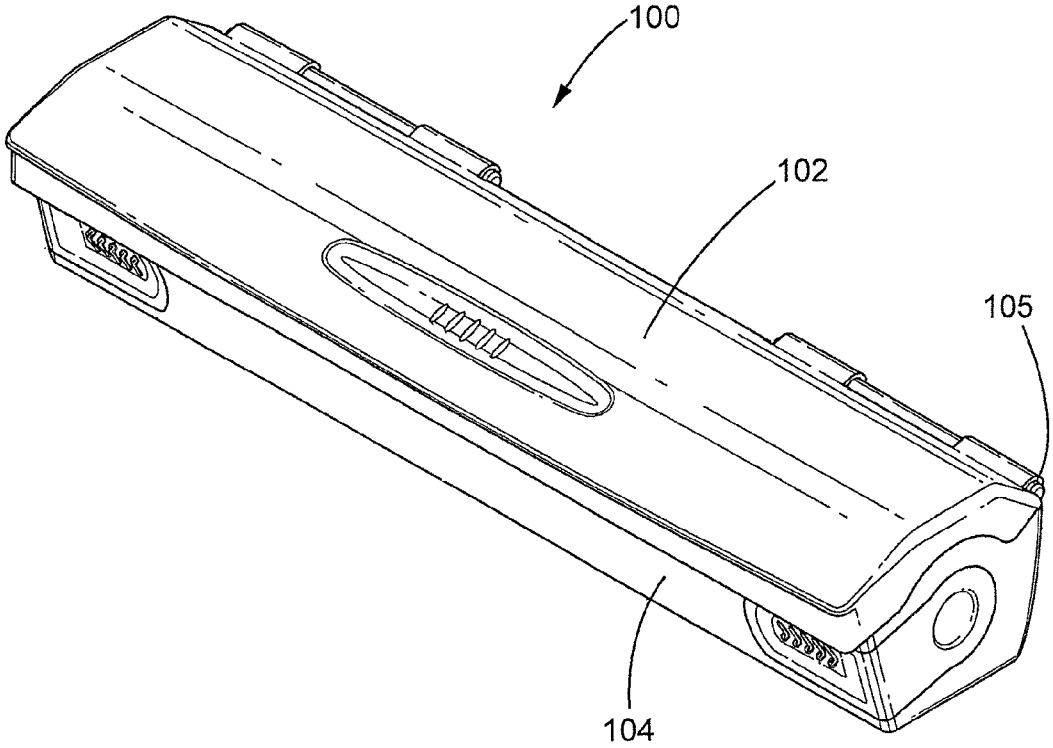
FIG. 1 is a top perspective view of the container.
Figure 2:
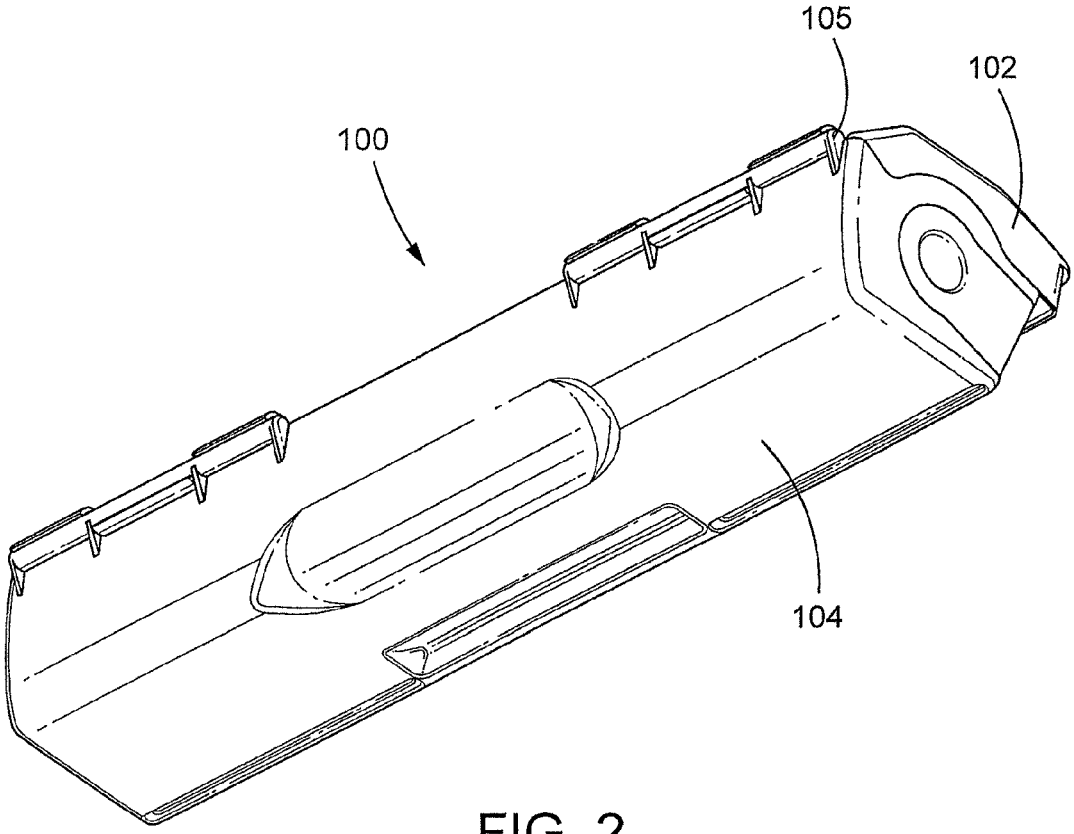
FIG. 2 is a bottom perspective view of the container.

Referring to FIG. 1, the container 100 may include a first container portion 102 and a second container portion 104. In one embodiment, the first container portion 102 may be a lid and the second container portion 104 may be a bottom housing. The first container portion 102 may move relative to the second container portion 104. In one embodiment, the first container portion 102 may pivot relative to the second container portion 104 at pivot point 105. In one embodiment, the pivot point may be a hinge.

Figure 3:
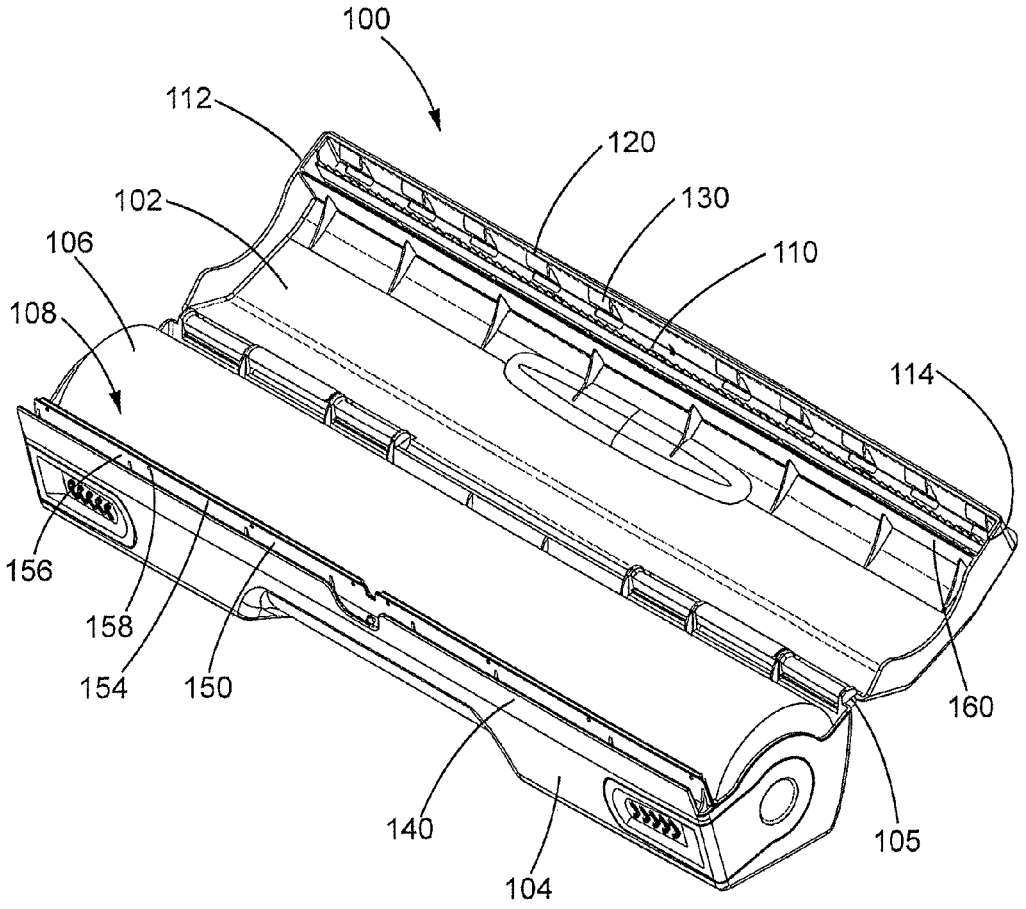
FIG. 3 is a top perspective view of the container with the lid pivoted away from the bottom of the container.

Referring to FIG. 3, the second container portion 104 may hold the material 106. The second container portion 104 may have an interior space 108 to store the material 106. In one embodiment, the material may be plastic wrap. In other embodiments, the material may be aluminum foil, parchment paper, wax paper, or other materials requiring dispensing into discrete sheets. In one embodiment, the material may be in a roll format. The material may be applied to a cylindrical core. The core may be made of paper, plastic, metal or other suitable materials. In other embodiments, the material may be in a non-roll format.

Figure 4:
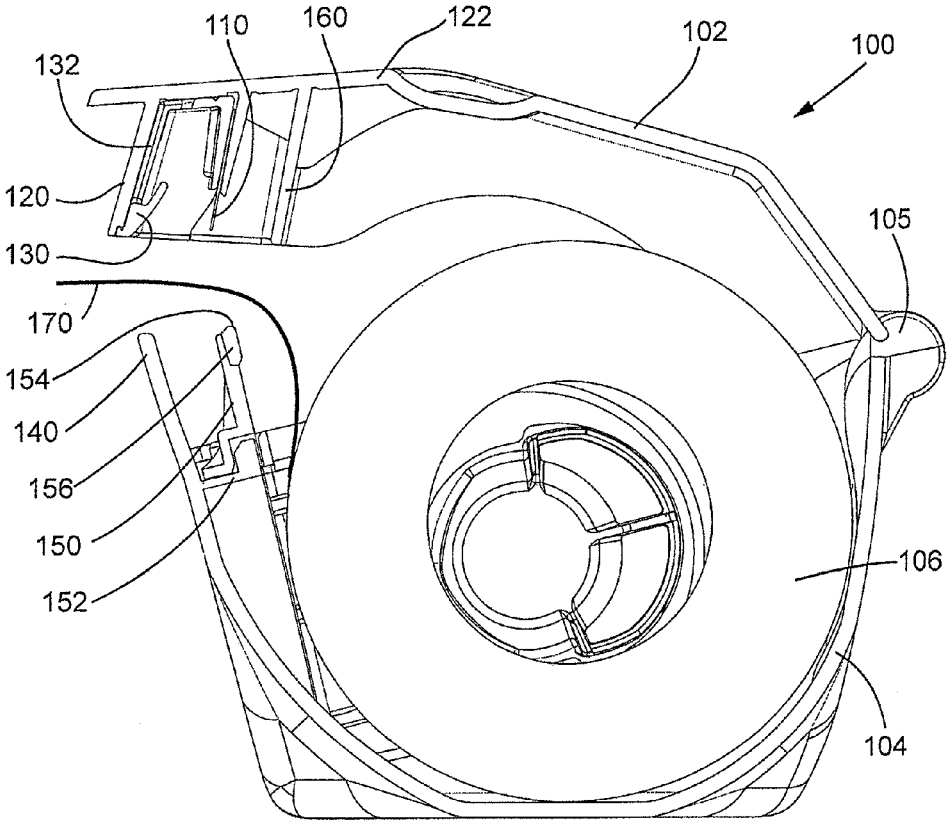
FIG. 4 is a cross-sectional view taken along line 4-4 in FIG. 1 showing the lid in an open position.

Referring to FIG. 3, the first container portion 102 may include a cutting portion 110. The cutting portion 110 may be used to cut the material 106. In one embodiment, the cutting portion 110 may have a series of peaks and valleys. In other embodiments, the cutting portion may have a straight edge. In one embodiment, the cutting portion may be made of plastic. In another embodiment, the cutting portion may be made of metal. In one embodiment, the cutting portion may extend from the first end 112 to the second end 114 of the first container portion 102. In other embodiments, the cutting portion may not extend from the first end 112 to the second end 114. In one embodiment, the cutting portion may be longer than or equal to the width of the material 106. The cutting portion may be a single blade. In other embodiments, the cutting portion may be two or more blades. Referring to FIG. 4, the cutting portion 110 may extend downward towards the second container portion 104.

Referring to FIGS. 3 and 4, the first container portion 102 may include a first leg 120. The first container portion 102 may include a base portion 122. The first leg 120 may extend away from the base portion 122.

The first leg may include an engagement member. For example, referring to FIGS. 3 and 4, the first leg 120 may include an engagement member 130. In one embodiment, the engagement member 130 may extend toward the second leg 140. In one example, the engagement member 130 may be a spring finger positioned at an angle relative to the first leg 120 as shown in FIG. 4. In one embodiment, the engagement member 130 may be made of the same material as the first leg. In another embodiment, the engagement member 130 may be made of a different material than the first leg. The engagement member may be made of plastic. In another embodiment, the engagement member may be made of metal.

In one embodiment, the engagement member may be two or more engagement members disposed on the first leg, such as, shown in FIG. 3. In one embodiment, the engagement members may be evenly spaced from each other. In another embodiment, the engagement members may not be evenly spaced.

In another embodiment, a single engagement member may be disposed on the first leg. The single engagement member may extend from the first end 112 to the second end 114. In another embodiment, the single engagement member may not extend from the first end 112 to the second end 114.

In one embodiment, the engagement member may be attached to the first leg with the assistance of a retaining member. In one example, the retaining member 132 may extend along the first leg 120. The engagement member 130 may be attached to the retaining member. For example, the engagement member 130 and the retaining member may be molded or formed as a unitary part. In another example, the retaining member may be molded and then the engagement member 130 may be molded onto the retaining member. In a further example, the engagement member 130 may be attached with an adhesive to the retaining member. In another example, the engagement member 130 may be press fit into openings in the retaining member.

The retaining member 132 may be attached to the first leg 120. For example, the retaining member 132 may be attached using fusion bonding. In another example, the retaining member may be attached using an adhesive.

In another embodiment, the engagement member 130 and the first leg 120 may be molded or formed as a unitary part.

The engagement member may engage the second leg during the cutting process. For example, referring to FIG. 5, the engagement member 130 may engage the second leg 140. In addition, the engagement member may disengage from the second leg during the cutting process. For example, referring to FIG. 6, the engagement member 130 may disengage from the second leg 140.

In one embodiment, the second container portion 104 may include a third leg 150 as shown in FIGS. 3 and 4. The second container portion 104 may include a base portion 152. The third leg 150 may extend away from the base portion 152. The third leg 150 may be located near the second leg 140. In one embodiment, the third leg 150 may be adjacent the second leg 140. In one embodiment, the third leg 150 may be parallel to the second leg 140.

The third leg 150 may be attached to the second container portion 104. For example, the third leg 150 may be attached using fusion bonding. In another example, the third leg 150 may be attached using an adhesive. In another embodiment, the third leg 150 and the second container portion 104 may be molded or formed as a unitary part.

The third leg 150 may include a slip reducing surface 154. The slip reducing surface may increase the coefficient of friction between the material 106 and the third leg 150. In one embodiment, the slip reducing surface 154 may be a material 156 which is applied to the third leg as shown in FIGS. 3 and 4. For example, the slip reducing surface may be a thermoplastic elastomer applied to the third leg. The thermoplastic elastomer may increase the coefficient of friction between the material 106 and the third leg 150. In one embodiment, the third leg 150 may include holes 158 as shown in FIG. 3. The holes 158 may allow the material 156 to enter the holes 158 and help retain the material 156 to the third leg 150. In another embodiment, the slip reducing surface 154 may be a texture on the third leg 150. For example, the texture may be created when the third leg is formed. In another example, the texture may be created by a chemical or mechanical process. In a further embodiment, the slip reducing surface 154 may be a gloss finish on the third leg 150. For example, the gloss finish may be created when the third leg is formed. In another example, the gloss finish may be created by a chemical or mechanical process.

Figure 6:
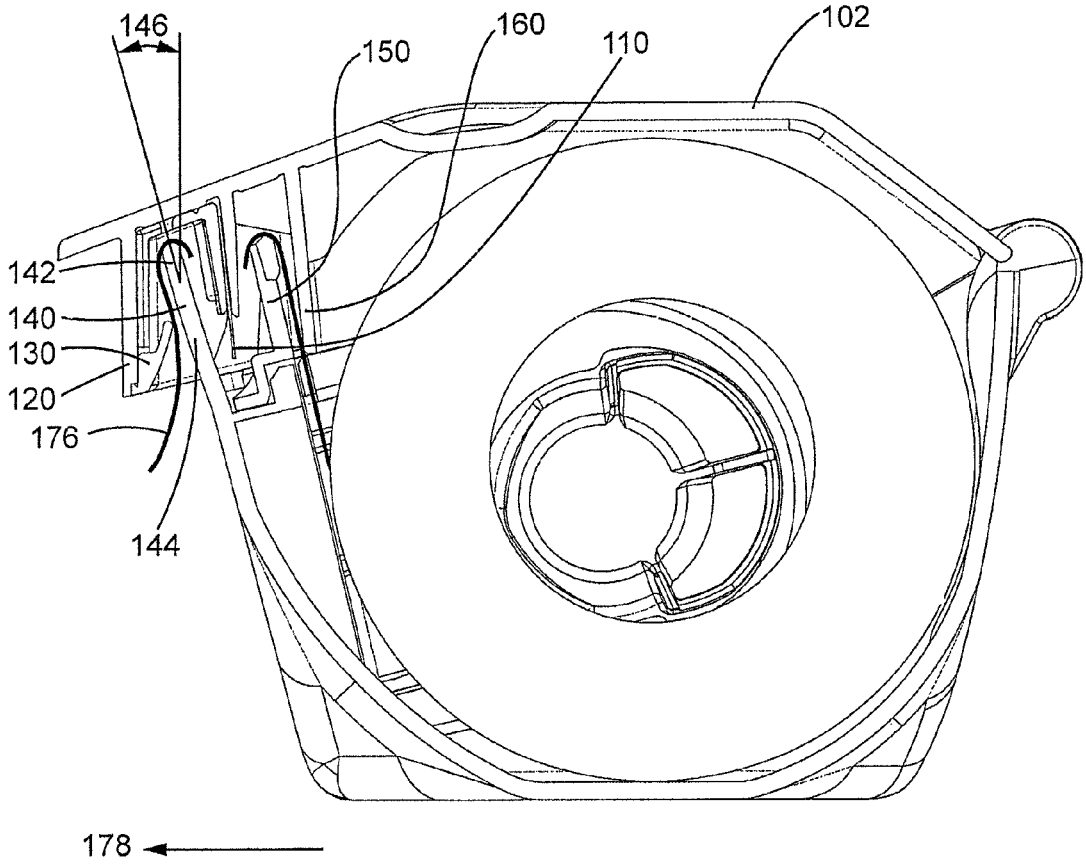
FIG. 6 is a cross-sectional view showing the lid in a closed position.

In one embodiment, the first container portion 102 may include a fourth leg 160 as shown in FIGS. 3 and 4. The fourth leg 160 may extend away from the base portion 122. The fourth leg 160 may be located near the first leg 120. In one embodiment, the fourth leg 160 may be adjacent to the cutting portion 110. In one embodiment, the fourth leg 160 may be parallel to the cutting portion. The fourth leg 160 may be positioned so that the fourth leg 160 is located on the outside of the third leg 150 in the closed position as shown in FIG. 6.

Figure 5:
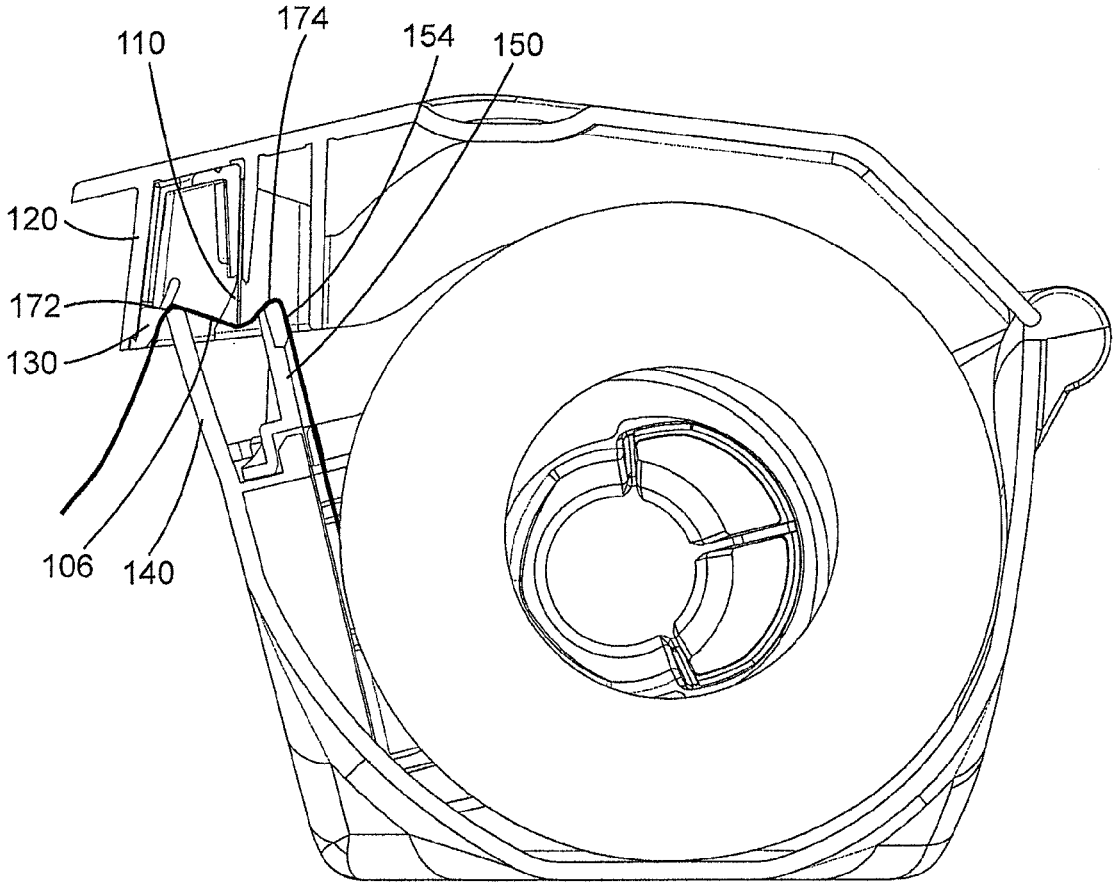
FIG. 5 is a cross-sectional view showing the lid in an intermediate position.

The container will operate in the following manner. Referring to FIG. 4, the user pulls out the free end 170 of the material 106 to the desired length. When the user wishes to cut the material, the user pushes down on the first container portion 102. The engagement member 130 engages the second leg 140 as shown in FIG. 5. The engagement member 130 interferes with the second leg 140. The engagement member 130 may deform as it moves along the second leg 140. The material 106 is held between the engagement member 130 and the second leg 140 at location 172.

In one embodiment, the material 106 may also contact the third leg 150. The third leg 150 may assist in holding the material at location 174. In one embodiment, the third leg 150 may include the slip reducing surface 154. The slip reducing surface 154 may assist in holding the material at location 174. In other embodiments, the slip reducing surface may not be used.

In addition, the cutting portion 110 will contact the material 106 when the user pushes down on the first container portion 102. The cutting portion 110 will cut the material 106. The cutting of the material is assisted by the material 106 being held between the engagement member 130 and the second leg 140. In addition, the cutting of the material 106 may be assisted by the holding of the material on the third leg 150. The holding of the material in tension may facilitate the cutting of the material.

As the user continues to push down on the first container portion 102, the engagement member 130 disengages from the second leg 140 as shown in FIG. 6. In one embodiment, the engagement member 130 disengages from the second leg 140 due to the configuration of the engagement member 130 and the configuration of the second leg 140. For example, referring to FIG. 6, the upper portion 142 of the second leg 140 is closer to the engagement member 130 in the X-axis 178 than a lower portion 144 of the second leg 140. In one embodiment, the reduction in distance may be achieved when the second leg 140 is oriented at an angle 146 with respect to the end of the engagement member 130. In another example, the upper portion of the second leg may be stepped relative to the lower portion of the second leg so that the upper portion of the second leg may be closer to the engagement member 130 in the X-axis than the lower portion of the second leg.

Referring to FIG. 6, when the engagement member 130 disengages from the second leg 140, the portion 176 of material which has been cut, is no longer held between the engagement member 130 and the second leg 140. Consequently, the portion 176 of material may be removed when the engagement member 130 disengages from the second leg 140. Therefore, when the first container portion 102 is in the closed position, the portion 176 of material may be removed. Thus, the user can remove the portion 176 of material without opening the first container portion 102.

The engagement member may also create an involuntary increase in cutting speed by the user. Referring to FIG. 5, when the user pushes on the first container portion 102, the engagement between the engagement member 130 and the second leg 140 creates resistance as the user pushes on the first container portion 102. After the engagement member 130 disengages from the second leg 140, the force required by the user decreases and the user involuntarily increases the speed of the first container portion 102. The increase in speed may aid in cut quality.

The disengagement of the engagement member from the second leg may provide a tactile indication to the user that the cutting operation has been completed. The user may feel that resistance has been reduced when the engagement member 130 disengages from the second leg 140.

The user may also receive an auditory indication that the cutting operation has been completed. The disengagement of the engagement member 130 from the second leg 140 may provide an auditory indication, such as, a sound.

Depending upon the material and finish choices for the engagement member, the film material tension can be elevated by actively pulling the film material outward. Also, the rigidity, slope, and surface finish of the engagement member can be altered to find the desired balance of robust performance and user acceptance of cut force.

Figure 7:
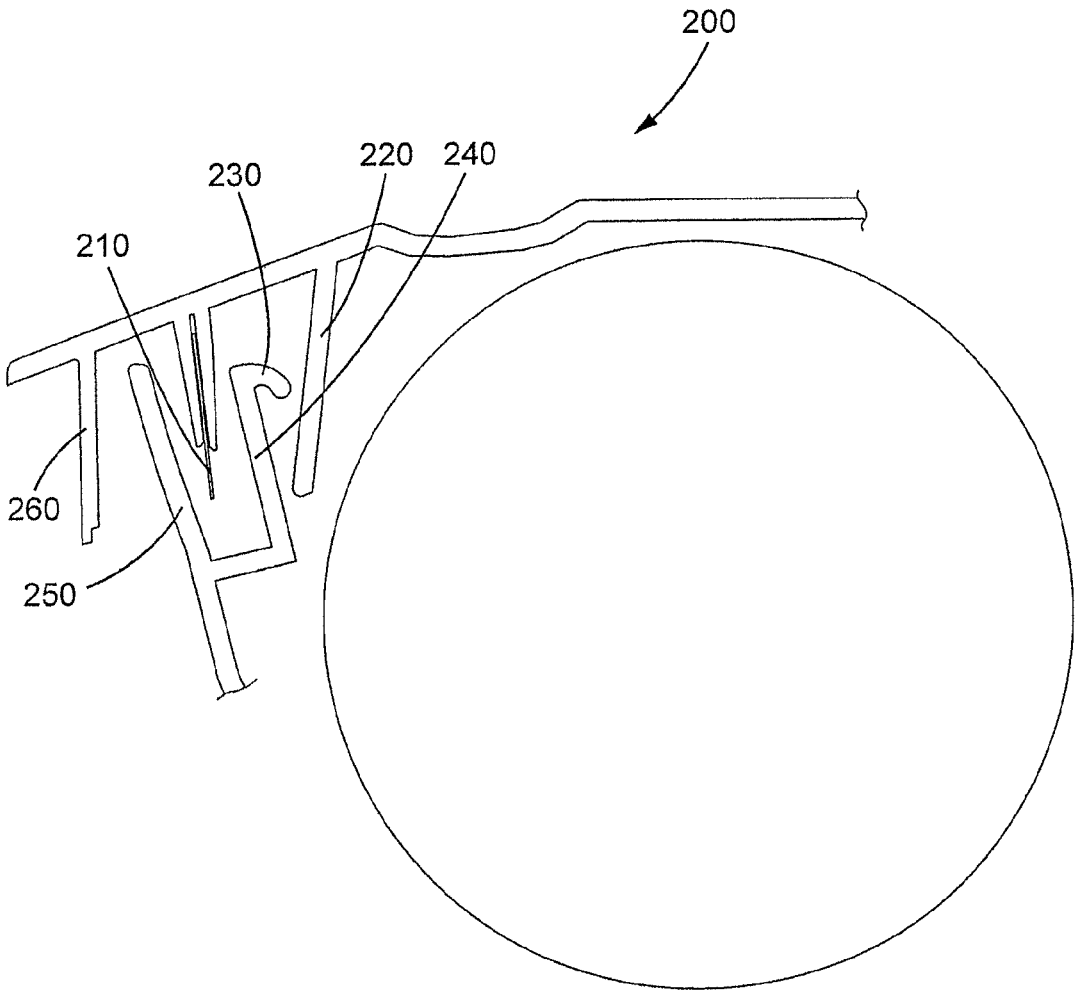
FIG. 7 is a cross-sectional view of another embodiment.

Referring to FIG. 7, another embodiment of a container is shown. The container 200 may be similar to container 100 except as noted below. The container 200 is shown in the closed position. The engagement member 230 is located on the second leg 240. The second leg 240 may be located between the cutting portion 210 and the first leg 220. In one embodiment, the third leg 250 may include a slip reducing surface. The container 200 may include a fourth leg 260.

Figure 8:
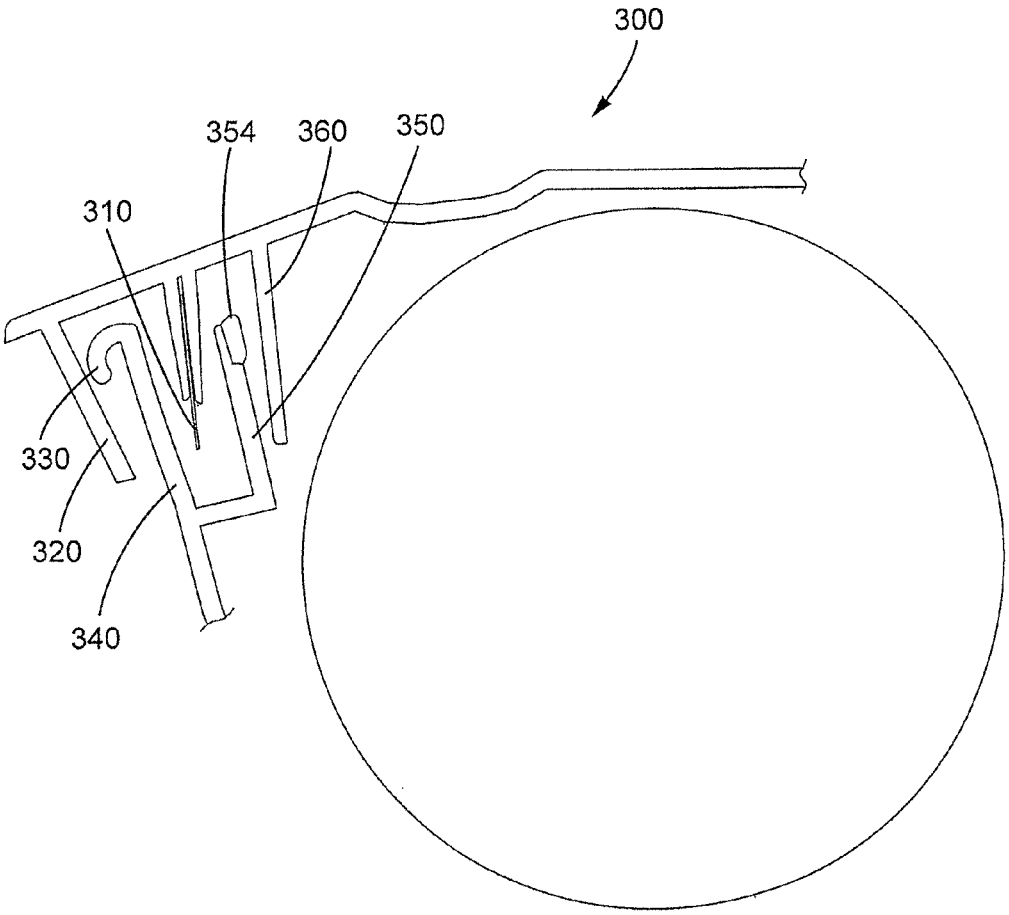
FIG. 8 is a cross-sectional view of another embodiment.

Referring to FIG. 8, another embodiment of a container is shown. The container 300 may be similar to container 100 except as noted below. The container 300 is shown in the closed position. The engagement member 330 is located on the second leg 340. The second leg 340 may be located between the cutting portion 310 and the first leg 320. In one embodiment, the third leg 350 may include a slip reducing surface 354. The container 300 may include a fourth leg 360.

Figure 9:
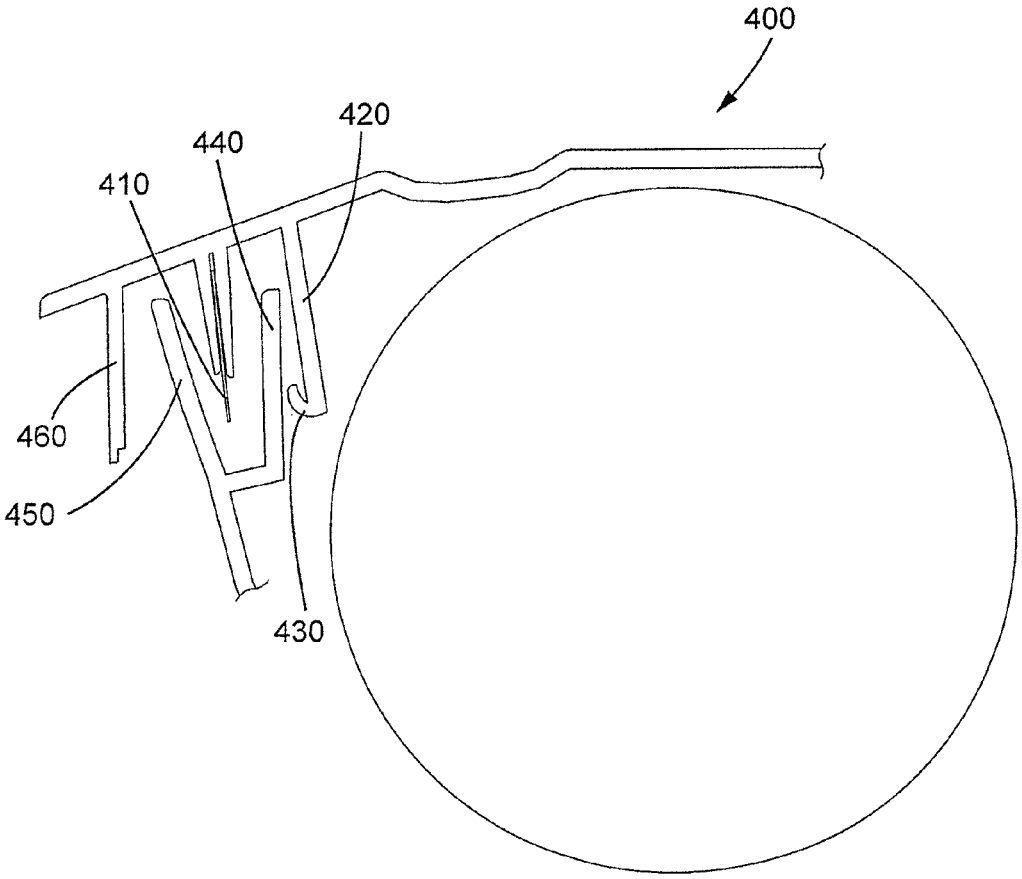
FIG. 9 is a cross-sectional view of another embodiment.

Referring to FIG. 9, another embodiment of a container is shown. The container 400 may be similar to container 100 except as noted below. The container 400 is shown in the closed position. The engagement member 430 is located on the first leg 420. The second leg 440 may be located between the cutting portion 410 and the first leg 420. In one embodiment, the third leg 450 may include a slip reducing surface. The container 400 may include a fourth leg 460.

Figure 10:
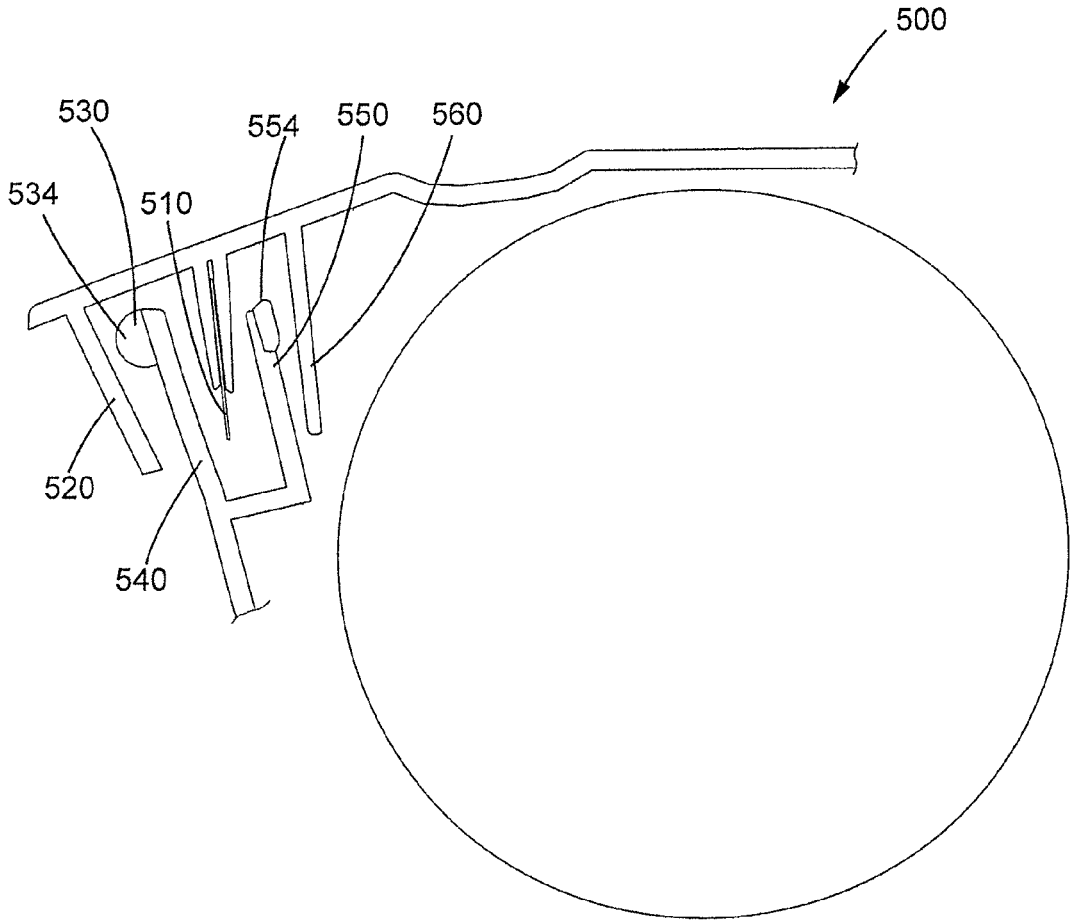
FIG. 10 is a cross-sectional view of another embodiment.

Referring to FIG. 10, another embodiment of a container is shown. The container 500 may be similar to container 100 except as noted below. The container 500 is shown in the closed position. The engagement member 530 is located on the second leg 540. The second leg 540 may be located between the cutting portion 510 and the first leg 520. In one embodiment, the third leg 550 may include a slip reducing surface 554. The container 500 may include a fourth leg 560.

The engagement member 530 may be a material which extends from the second leg 540. In one embodiment, the material 534 may be applied to the second leg 540. In one example, the material may be applied as a bead of material. In one embodiment, the material may be applied in a line along the length of a portion of the second leg. In another embodiment, the material may be applied in segments along the second leg. In one embodiment, the material may be a soft material. The soft material may flex when it engages the first leg. For example, the material may be a thermoplastic elastomer, silicone, or other suitable material. In another embodiment, the material may be a rigid material. The material 534 may help to grab the film material and may prevent the film material from being pulled backward by the cutting portion 510. The stiffness, slope and surface finish of the engagement member can be altered to find the desired balance of robust performance and user acceptance of cut force.

Figure 11:
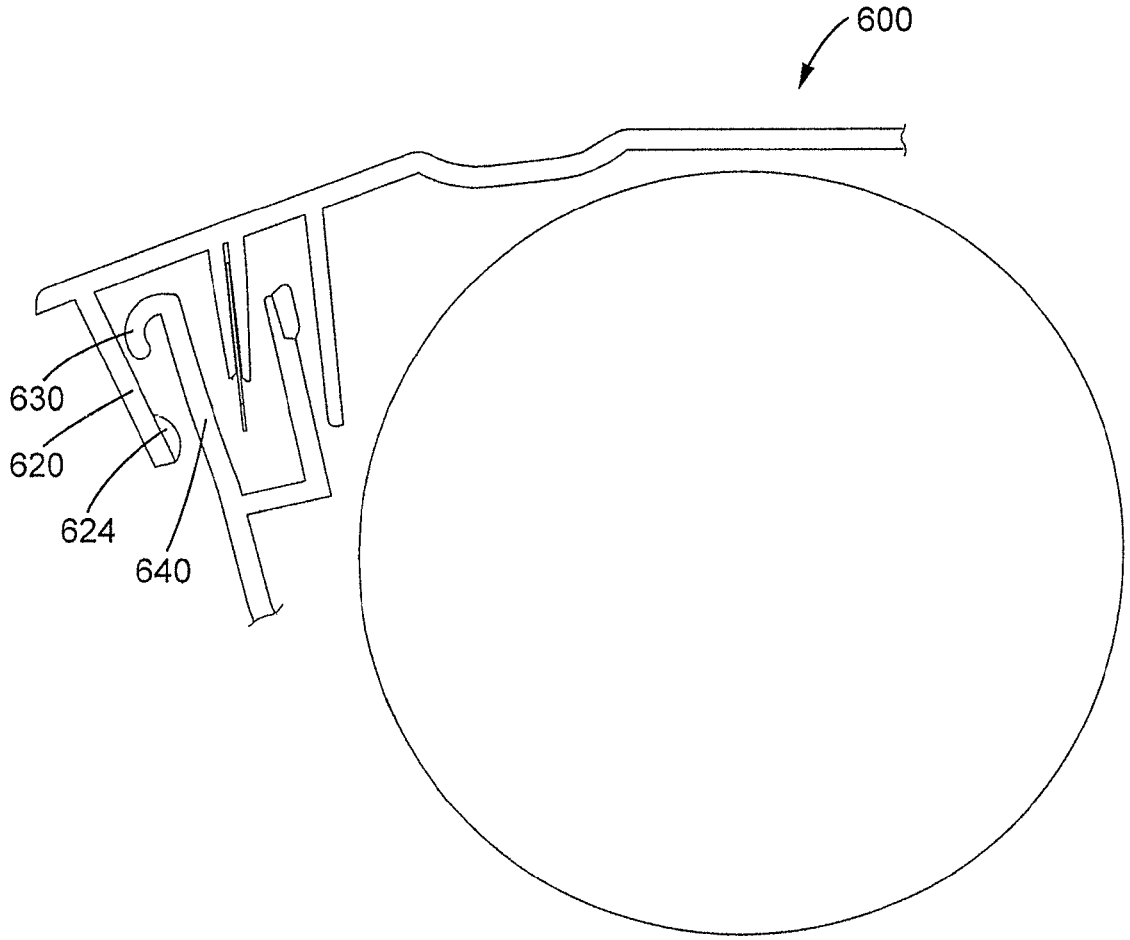
FIG. 11 is a cross-sectional view of another embodiment.

Referring to FIG. 11, another embodiment of a container is shown. The container 600 may be similar to container 300 except as noted below. The container 600 is shown in the closed position. The engagement member 630 is located on the second leg 640. The first leg 620 may include a second engagement member 624. The second engagement member 624 may have the same features as described with respect to engagement member 530 and incorporated herein by reference. The engagement member 630 will engage the material and the second engagement member 624 during the cutting process.

Figure 12:
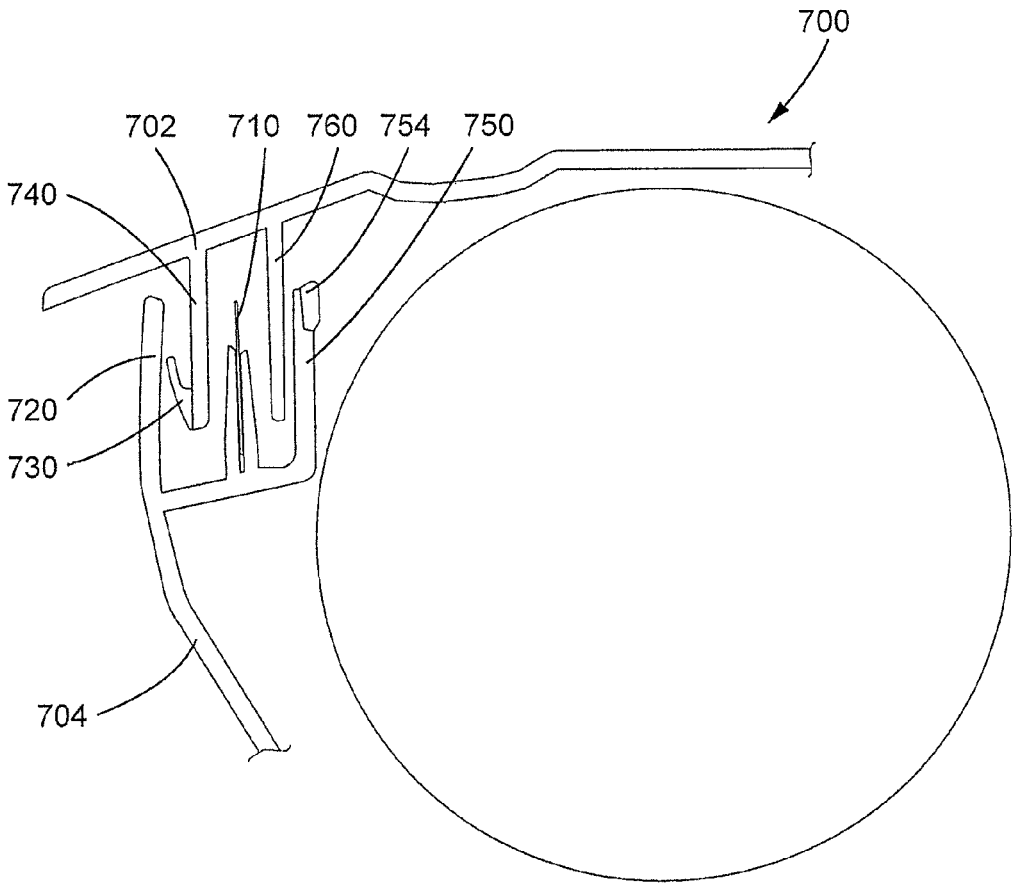
FIG. 12 is a cross-sectional view of another embodiment.

Referring to FIG. 12, another embodiment of a container is shown. The container 700 may be similar to container 100 except as noted below. The container 700 is shown in the closed position. The cutting portion 710 may be located on the second container portion 704. In addition, the first leg 720 may be located on the second container portion 704. The second leg 740 may be located on the first container portion 702. The engagement member 730 is located on the second leg 740. The second leg 740 may be located between the cutting portion 710 and the first leg 720. In one embodiment, the third leg 750 may include a slip reducing surface 754. The container 700 may include a fourth leg 760.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A container for dispensing a sheet material comprising a first container portion and a second container portion, the first container portion rotates relative to the second container portion, the first portion and the second portion have an open position, the first portion and the second portion have an intermediate position, the first portion and the second portion have a closed position that defines a furthest extent of rotation of the first container portion relative to the second container portion, one of the first container portion and second container portion is capable of holding a roll of sheet material, a cutting portion, one of the first container portion and the second container portion includes the cutting portion;

a first leg, the first leg is located on the container portion which includes the cutting portion;

a second leg, the second leg is located on the container portion without the first leg, wherein the second leg is not in contact with the first leg when the first container portion and the second container portion are in the closed position; and an engagement member, the engagement member is located on one of the first leg and the second leg, the engagement member engages the other of the first leg and second leg in the intermediate position to retain a portion of sheet material when directed therebetween, and wherein the engagement member disengages from contact with the other of the first leg and second leg in the closed position thereby allowing a cut portion of the sheet material to be removed from the container.

2. A container as in claim 1 wherein the engagement member is made of a first material and one of the first leg and the second leg are made of a second material, the first material is different than the second material.

3. A container as in claim 1 wherein a second engagement member is located on one of the first leg and the second leg, wherein the first engagement member and the second engagement member are not located on the same leg.

4. A container as in claim 1 wherein the first leg is not parallel to the second leg when the first container portion is in the closed position.

5. A container as in claim 1 wherein a third leg is located on the container portion without the first leg.

6. A container as in claim 5 wherein the third leg includes a slip reducing surface.

7. A container as in claim 6 wherein the slip reducing surface is a material applied to the third leg.

8. A container as in claim 1 wherein the cutting portion includes peaks and valleys.

9. A container as in claim 1 wherein the first container portion pivots relative to the second container portion.

10. A container as in claim 1 wherein a fourth leg is located on the container portion which includes the first leg.

11. A container as in claim 1 wherein the engagement member comprises a spring finger that deforms when it engages the other of the first leg and second leg so that the container provides a tactile indication when the engagement member disengages the other of the first leg and second leg.

12. A container as in claim 1 wherein the engagement member comprises a spring finger that deforms when it engages the other of the first leg and second leg so that the container provides an audible indication when the engagement member disengages the other of the first leg and second leg.

13. A container as in claim 1 wherein the container includes a roll of material.

14. A container as in claim 13 wherein the material is a plastic wrap.

15. A container as in claim 13 wherein the material is cut when the first container portion is moved to the closed position to create a cut portion of material, the cut portion can be removed from the container when the first container portion is in the closed position.

16. A container as in claim 1 wherein the engagement member is formed together of the same material with one of the first leg and the second leg.

17. A container for dispensing sheet material comprising:

a lid portion and a bottom housing portion capable of holding a roll of sheet material, the lid portion rotates relative to the bottom housing portion, the lid portion and the bottom housing portion have an open position, an intermediate position, and a closed position defining the furthest extent of rotation between the lid portion and bottom housing portion;

the lid portion includes a first leg and a cutting portion;

the bottom housing portion includes a second leg and a third leg which together define a cutting channel;

the first leg further including a spring finger having a first end attached to the first leg and a second free end extending towards the second leg;

wherein the first and second legs are not in contact with each other when the lid portion and the bottom container portion are in the closed position; and wherein sheet material directed between the first and second legs is held between the spring finger and the second leg as the container is moved into the intermediate position and the cutting portion is brought into contact with the sheet material, and wherein the spring finger disengages from contact with the second leg in the closed position thereby allowing a cut portion of the sheet material to be removed from the container.

18. A container as in claim 17 wherein the spring finger and first leg are made from the same material.

19. A container as in claim 17 wherein the spring finger is made of a first material and the first leg is made of a second material, the first material is different than the second material.

20. A container as in claim 17 wherein a third leg is located on the bottom housing portion and the third leg is provided with a slip reducing surface.

21. A container as in claim 17 wherein the spring finger deforms when it engages the second leg such that the container provides a tactile indication when the spring finger disengages from contact with second leg.

22. A container as in claim 17 wherein the spring finger deforms when it engages second leg such that the container provides an audible indication when the spring finger disengages from contact with the second leg.

23. A container for dispensing sheet material comprising:

a lid portion and a bottom housing portion capable of holding a roll of sheet material, the lid portion rotates relative to the bottom housing portion, the lid portion and the bottom housing portion have an open position, an intermediate position, and a closed position defining the furthest extent of rotation between the lid portion and bottom housing portion;

the lid portion includes a first leg and a cutting portion, the bottom housing portion includes a second leg and a third leg that together define a cutting channel, the second leg further including an engagement member having a first end attached to the second leg and a second free end extending towards the first leg;

wherein the first and second legs are not in contact with each other when the lid portion and the bottom container portion are in the closed position; and wherein sheet material directed between the first and second legs is held between the engagement member and the first leg as the container is moved into the intermediate position and the cutting portion is brought into contact with the sheet material, and wherein the engagement member disengages from contact with the first leg in the closed position thereby allowing a cut portion of the sheet material to be removed from the container.

24. A container as in claim 23 wherein the third leg is provided with a slip reducing surface.

25. A container as in claim 23 wherein the first leg is provided with a slip reducing surface.

* * * * *